US010764661B1

(12) United States Patent
Augspurger

(10) Patent No.: US 10,764,661 B1
(45) Date of Patent: Sep. 1, 2020

(54) LOUDSPEAKER ENCLOSURES AND LOUDSPEAKER DEVICES

(71) Applicant: George Augspurger, Los Angeles, CA (US)

(72) Inventor: George Augspurger, Los Angeles, CA (US)

(73) Assignee: Warner Music Inc., New York, NY (US)

( * ) Notice: Subject to any disclaimer, the term of this patent is extended or adjusted under 35 U.S.C. 154(b) by 0 days.

(21) Appl. No.: 16/177,978

(22) Filed: Nov. 1, 2018

Related U.S. Application Data

(60) Provisional application No. 62/692,404, filed on Jun. 29, 2018.

(51) Int. Cl.
*H04R 1/02* (2006.01)
*H04R 1/30* (2006.01)
(Continued)

(52) U.S. Cl.
CPC ..... *H04R 1/025* (2013.01); *H04R 1/24* (2013.01); *H04R 1/2826* (2013.01); *H04R 1/30* (2013.01);
(Continued)

(58) Field of Classification Search
CPC ..... H04R 1/025; H04R 1/026; H04R 1/1058; H04R 1/2888; H04R 1/2892;
(Continued)

(56) References Cited

U.S. PATENT DOCUMENTS 4,139,076 A * 2/1979 Hruby, Jr. ..... H04R 1/2811 181/148
5,875,255 A * 2/1999 Campbell ..... H04R 1/2819 181/199
8,189,822 B2 * 5/2012 Jakowski ..... H04R 1/26 381/182
2002/0061114 A1 * 5/2002 Croft, III ..... H04R 1/2842 381/345
2003/0066705 A1 * 4/2003 Schott ..... H04R 1/24 181/156
(Continued)

FOREIGN PATENT DOCUMENTS

CN 2840573 Y * 11/2006
FR 2378418 A1 * 8/1978 ..... H04R 1/26

OTHER PUBLICATIONS

KL650, KL650 THX Ultra2 Bookshelf Loudspeaker , Klipsch Home Theater (Year: 2004).*
(Continued)

*Primary Examiner* — Davetta W Goins
*Assistant Examiner* — Kuassi A Ganmavo
(74) *Attorney, Agent, or Firm* — Byrne Poh LLP

(57) ABSTRACT

Loudspeaker enclosures and loudspeaker devices are provided. In some embodiments, a loudspeaker device is provided, the loudspeaker device comprising: a loudspeaker enclosure, comprising: a rear side; and a front side of the loudspeaker enclosure comprising: a lower portion of the front side comprising a first opening for receiving a first loudspeaker and a second opening for receiving a second loudspeaker; and an upper portion of the front side comprising a third opening for receiving a third loudspeaker, a first port, and a second port, wherein a distance from the lower portion of the front side to the rear side is greater than a distance from the upper portion of the front side to the rear side; the first loudspeaker positioned in the first opening; the second loudspeaker positioned in the second opening; and the third loudspeaker positioned in the third opening.

20 Claims, 5 Drawing Sheets

(51) Int. Cl.

| | |
|---|---|
| ***H04R 1/28*** | (2006.01) |
| ***H04R 1/24*** | (2006.01) |
| *H04R 5/02* | (2006.01) |
| *H04R 1/10* | (2006.01) |
| *H04R 1/40* | (2006.01) |

(52) U.S. Cl.
CPC ..... *H04R 1/026* (2013.01); *H04R 1/1058* (2013.01); *H04R 1/2807* (2013.01); *H04R 1/288* (2013.01); *H04R 1/2811* (2013.01); *H04R 1/2849* (2013.01); *H04R 1/2888* (2013.01); *H04R 1/2892* (2013.01); *H04R 1/2896* (2013.01); *H04R 1/406* (2013.01); *H04R 5/02* (2013.01); *H04R 2201/02* (2013.01)

(58) Field of Classification Search
CPC .... H04R 1/2896; H04R 1/406; H04R 1/2807; H04R 1/2849; H04R 1/2861; H04R 1/2865; H04R 1/2869; H04R 5/02; H04R 2201/02; H04R 2201/025; H04R 1/2811; H04R 3/14; H04R 1/288
See application file for complete search history.

(56) References Cited

U.S. PATENT DOCUMENTS

| | | | | |
|---|---|---|---|---|
| 2004/0052393 | A1* | 3/2004 | Bronson, III | H04R 1/323 381/345 |
| 2005/0013454 | A1* | 1/2005 | Huang | H04R 1/26 381/182 |
| 2007/0076912 | A1* | 4/2007 | Griffiths | H04R 1/02 381/345 |
| 2008/0137894 | A1* | 6/2008 | Christner | H04R 1/323 381/349 |
| 2009/0190784 | A1* | 7/2009 | Ong | H04R 1/2819 381/351 |
| 2009/0226019 | A1* | 9/2009 | Koren | H04R 1/2819 381/345 |
| 2019/0261087 | A1* | 8/2019 | Petracek | H04R 5/02 |

OTHER PUBLICATIONS

Dynaudio, Dynaudio M1.5 (Year: 2005).*
Ecoustics, Port distance (Year: 2007).*
Silver5L, "Silver—Design & Build", in Silver5L.com, pp. 1-4, available at: https://web.archive.org/web/20170703103308/http://silver5l.com/design-build.

* cited by examiner

LOUDSPEAKER ENCLOSURES AND LOUDSPEAKER DEVICES

CROSS-REFERENCE TO RELATED APPLICATIONS

This application claims the benefit of U.S. Provisional Patent Application No. 62/692,404, filed Jun. 29, 2018, which is hereby incorporated by reference herein in its entirety.

TECHNICAL FIELD

The disclosed subject matter relates to loudspeaker enclosures and loudspeaker devices.

BACKGROUND

The demands of recording studio monitors (i.e., loudspeakers) are changing as studio spaces change. For example, more of today's recording studios are smaller and have structural limitations, and loudspeaker designs need to reflect budget and space requirements.

Accordingly, it is desirable to provide new designs for loudspeaker enclosures and loudspeaker devices.

SUMMARY

Loudspeaker enclosures and loudspeaker devices are provided. In accordance with some embodiments of the disclosed subject matter, a loudspeaker enclosure is provided, the loudspeaker enclosure comprising: a rear side; and a front side of the loudspeaker enclosure comprising: a lower portion of the front side comprising a first opening for receiving a first loudspeaker and a second opening for receiving a second loudspeaker; and an upper portion of the front side comprising a third opening for receiving a third loudspeaker, a first port, and a second port, wherein a distance from the lower portion of the front side to the rear side is greater than a distance from the upper portion of the front side to the rear side.

In some embodiments, the upper portion of the front side further comprises: a first support body that defines at least a portion of the first port and at least a portion of the third opening; and a second support body that defines at least a portion of the second port and at least a portion of the third opening.

In some embodiments, a first line extending from a center of the first port to a center of the second port passes through at least a portion of the third opening; and a second line extending from a center of the first opening to a center of the second opening is parallel to the first line.

In some embodiments, the first opening has a substantially circular shape for receiving a woofer loudspeaker; the second opening has a substantially circular shape for receiving a woofer loudspeaker; and the third opening has a substantially rectangular shape for receiving a horn loudspeaker.

In some embodiments, the first port has a substantially rectangular shape; and the second port has a substantially rectangular shape.

In some embodiments, the loudspeaker enclosure further comprises a divider partially bisecting an interior portion of the loudspeaker enclosure.

In some embodiments, the divider comprises a hole formed in a center thereof.

In some embodiments, the first port and the second port are arranged on the upper portion of the front side adjacent to respective lateral sides of the third opening; and the third opening has a substantially rectangular shape for receiving a horn loudspeaker that protrudes from the upper portion of the front side.

In accordance with some embodiments of the disclosed subject matter, a loudspeaker device is provided, the loudspeaker device comprising: a loudspeaker enclosure, comprising: a rear side; and a front side of the loudspeaker enclosure comprising: a lower portion of the front side comprising a first opening for receiving a first loudspeaker and a second opening for receiving a second loudspeaker; and an upper portion of the front side comprising a third opening for receiving a third loudspeaker, a first port, and a second port, wherein a distance from the lower portion of the front side to the rear side is greater than a distance from the upper portion of the front side to the rear side; the first loudspeaker positioned in the first opening; the second loudspeaker positioned in the second opening; and the third loudspeaker positioned in the third opening.

In some embodiments, the first loudspeaker is a woofer loudspeaker; the second loudspeaker is a woofer loudspeaker; and the third loudspeaker is a horn loudspeaker.

In some embodiments, the third loudspeaker is a horn loudspeaker that protrudes from the upper portion of the front side; and the first port and the second port are arranged on the upper portion of the front side adjacent to respective lateral sides of the third loudspeaker.

In accordance with some embodiments of the disclosed subject matter, a loudspeaker device is provided, the loudspeaker device comprising: a rear side; and a front side of the loudspeaker enclosure comprising: a lower portion of the front side comprising a first opening and a second opening, wherein the first opening and the second opening are horizontally aligned; and an upper portion of the front side comprising a third opening, a first port, and a second port, wherein the first port and the second port are arranged on the upper portion of the front side adjacent to respective lateral sides of the third opening; wherein a distance from the lower portion of the front side to the rear side is greater than a distance from the upper portion of the front side to the rear side; a first woofer loudspeaker positioned in the first opening; a second woofer loudspeaker positioned in the second opening; and a horn loudspeaker positioned in the third opening.

In some embodiments, a first ratio between a diameter of the first opening and a distance between a center of the first opening and a center of the second opening is 9:11; and a second ratio between a width of the first port and a height of the first port is 5:28.

In some embodiments, the diameter of the first opening is 9 inches; the distance between the center of the first opening and the center of the second opening is 11 inches; the width of the first port is 1¼ inches; and the height of the first port is 7 inches.

In some embodiments, a third ratio between a width of the first port and a depth of the first port is 1:3.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments, mechanisms for providing sound (which can include loudspeaker enclosures and loudspeaker devices) are provided.

It is noted that numerical values recited herein are modified by the term "about," whether or not expressly stated. As used herein, the term "about" defines the numerical boundaries of the modified numerical value so as to include, but not be limited to, tolerances and values up to and including the modified numerical value. That is, numerical values can include the actual value that is expressly recited as well as a range of other values that one of ordinary skill in the art would consider equivalent to the recited numerical value (i.e., having the same function or result).

Figure 1:
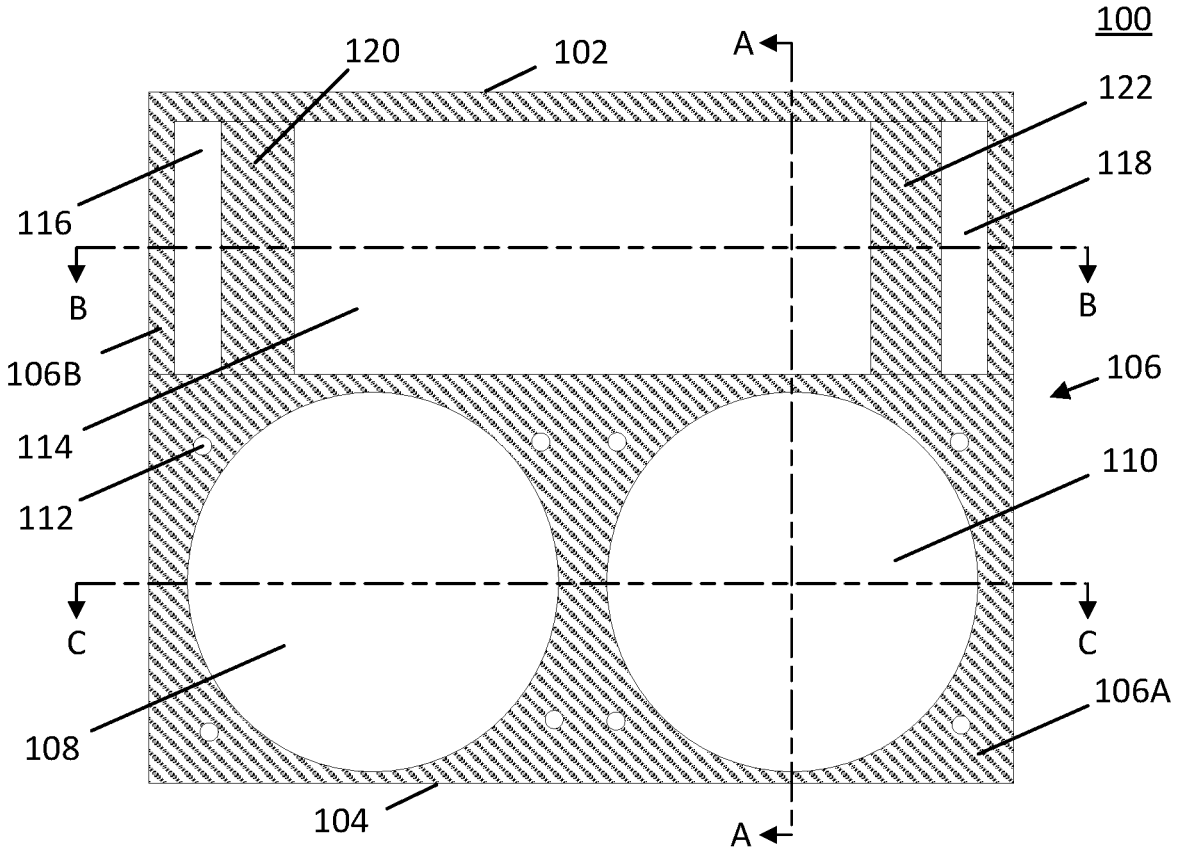
FIG. 1 shows an example of a front view of a loudspeaker enclosure in accordance with some embodiments of the disclosed subject matter.

Turning to FIG. 1, an example of a front view of a loudspeaker enclosure 100 in accordance with some embodiments of the disclosed subject matter is shown. As illustrated, in some embodiments, loudspeaker enclosure 100 can include a top side 102, a bottom side 104, and a front side 106. In some embodiments, front side 106 can include a lower front side 106A and an upper front side 106B.

In some embodiments, lower front side 106A can be any suitable shape and/or size. For example, in some embodiments, lower front side 106A can be a substantially flat rectangle. As a more particular example, in some embodiments, lower front side 106A can be a substantially flat rectangle having a width of 23½ inches, a height of 11¼ inches, and/or a thickness of ¾ inches.

In some embodiments, lower front side 106A can include opening 108 and/or opening 110 for receiving a pair of loudspeakers. In some embodiments, opening 108 and opening 110 can be any suitable shape and/or size. For example, in some embodiments, opening 108 and opening 110 can each be a substantially circular opening for receiving a woofer loudspeaker. As a more particular example, in some embodiments, opening 108 and/or opening 110 can each be a substantially circular opening that is 9 inches in diameter. In some embodiments, opening 108 and/or opening 110 can be arranged on lower front side 106A in any suitable manner. For example, in some embodiments, opening 108 and opening 110 can be horizontally aligned on lower front side 106A. As a more particular example, in some embodiments, opening 108 and opening 110 can be arranged on front side 106A such that a line extending from a center of opening 108 to a center of opening 110 is substantially parallel to a horizontal edge of loudspeaker enclosure 100, such as an edge of top side 102 and/or an edge of bottom side 104. In some embodiments, opening 108 can be spaced from opening 110 such that a center of opening 108 is 11 inches from a center of opening 110.

In some embodiments, lower front side 106A can include at least one fastener 112 adjacent to each of opening 108 and opening 110 for mounting a loudspeaker in each of opening 108 and opening 110. For example, in some embodiments, lower front side 106 can include four fasteners 112 adjacent to each of opening 108 and opening 110. In some embodiments, front side 106 can include any suitable number of fasteners 112 adjacent to each of opening 108 and/or opening 110. In some embodiments, fasteners 112 can be arranged on front side 106 in any suitable manner. In some embodiments, fasteners 112 can include one or more threaded nuts, such as a T-nut. In some embodiments, each fastener 112 can be cemented in place in front side 106 of loudspeaker enclosure 100.

In some embodiments, upper front side 106B can be any suitable shape and/or size. For example, in some embodiments, upper front side 106B can be a substantially flat rectangle. As a more particular example, in some embodiments, upper front side 106B can be a substantially flat rectangle having a width of 23½ inches, a height of 7¾ inches, and/or a thickness of ¾ inches.

In some embodiments, upper front side 106B can include an opening 114 for receiving a loudspeaker. In some embodiments, opening 114 can be any suitable shape and/or size. For example, in some embodiments, opening 114 can be a substantially rectangular opening for receiving a horn loudspeaker. As a more particular example, in some embodiments, opening 114 can be a substantially rectangular opening having a width of 15 inches and/or a height of 7 inches. In some embodiments, opening 114 can be arranged on upper front side 106B in any suitable manner. For example, in some embodiments, opening 114 can be horizontally centered on upper front side 106B.

In some embodiments, upper front side 106B can include port 116 and/or port 118. In some embodiments, port 116 and port 118 can be any suitable shape and/or size. For example, in some embodiments, port 116 and port 118 can each be a substantially rectangular port. As a more particular example, in some embodiments, port 116 and/or port 118 can each be a substantially rectangular port having a width of 1¼ inches, a height of 7 inches, and/or a depth of 3¾ inches. In some embodiments, a size of each of port 116 and port 118 can be selected to suitably tune port 116 and port 118 to achieve optimum low frequency response. In some embodiments, port 116 and port 118 can be arranged on upper front side 106B in any suitable manner. For example, in some embodiments, port 116 and port 118 can be horizontally aligned on upper front side 106B such that opening 114 is arranged between port 116 and port 118. In some embodiments, port 116 and port 118 can be arranged on upper front side 106B adjacent to respective lateral sides of opening 114. As a more particular example, in some embodiments, port 116 and port 118 can be arranged on front side 106 such that a line extending from a center of port 116 to a center of port 118 passes through at least a portion of opening 114. Additionally or alternatively, in some embodiments, port 116 and port 118 can be arranged on front side 106 such that a line extending from a center of port 116 to a center of port 118 is substantially parallel to a horizontal edge of loudspeaker enclosure 100, such as an edge of top side 102 and/or an edge of bottom side 104. As another example, port 116 and port 118 can be arranged on front side 106 such that a line extending from a center of port 116 to a center of port 118 is substantially parallel to a line extending from a center of opening 108 to a center of opening 110. As yet another example, in some embodiments, port 116 and port 118 can be arranged on front side 106 such that a center of opening 114 is incident on a line extending from a center of port 116 to a center of port 118.

In some embodiments, top side 102 and bottom side 104 can each have any suitable thickness. For example, in some embodiments, top side 102 and bottom side 104 can each have a thickness of ¾ inches. In some embodiments, an interior of top side 102 can define at least a portion of port 116. Similarly, in some embodiments, an interior of top side 102 can define at least a portion of port 118.

In some embodiments, loudspeaker enclosure 100 can include support body 120 and support body 122. In some embodiments, support body 120 and support body 122 can be any suitable shape and/or size. For example, in some embodiments, support body 120 and support 122 can each be substantially L-shaped, as is shown in more detail in connection with FIGS. 2 and 3. As a more particular example, in some embodiments, support body 120 and/or support body 122 can each be substantially L-shaped and each have a width of 2¼ inches, a height of 7 inches, and/or a depth of 3¾ inches. In some embodiments, respective sizes of each of support body 120 and support body 122 can be selected to suitably tune port 116 and port 118, respectively, to achieve optimum low frequency response. In some embodiments, support body 120 can be arranged on upper front side 106B to define at least a portion of port 116 and/or at least a portion of opening 114. Similarly, in some embodiments, support body 122 can be arranged on upper front side 106B to define at least a portion of port 118 and/or at least a portion of opening 114. In some embodiments, support body 120 and/or support body 122 can have any suitable arrangement on upper front side 106B and be coupled to loudspeaker enclosure 100 in any suitable manner.

Figure 2:
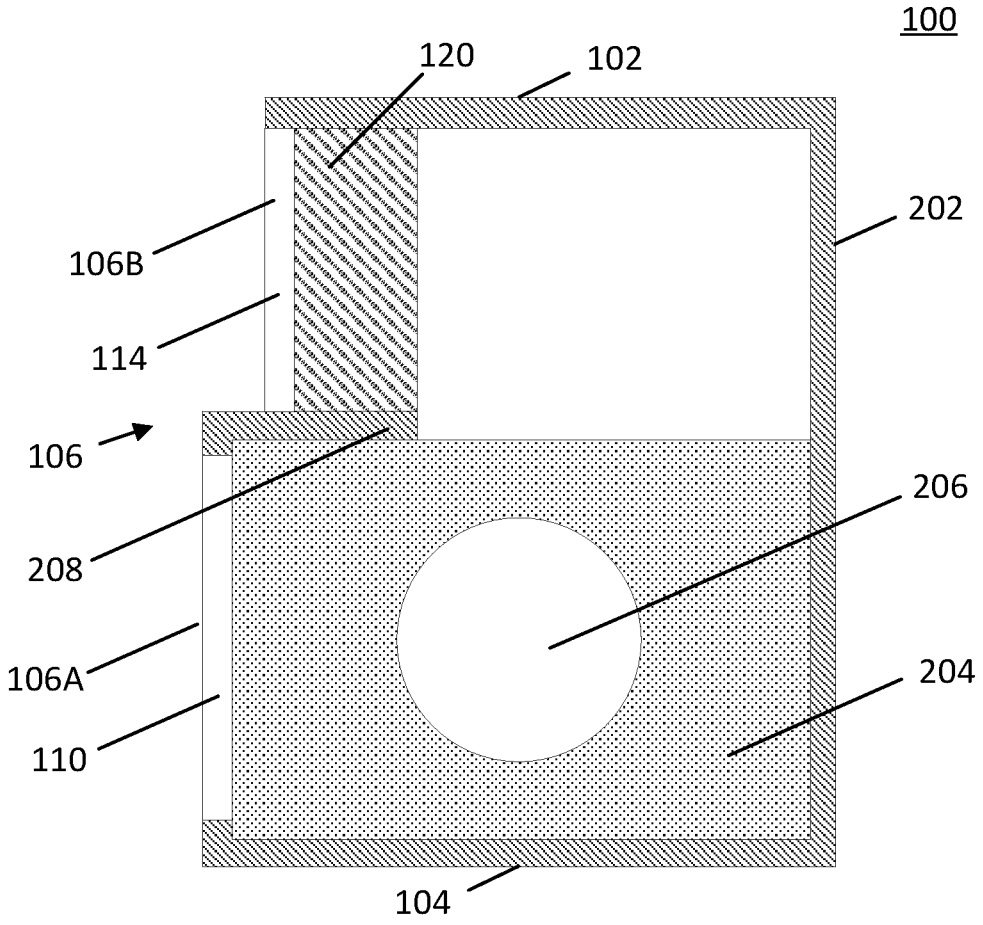
FIG. 2 shows an example of a cross-sectional view of a loudspeaker enclosure along line A-A in the front view of FIG. 1 in accordance with some embodiments of the disclosed subject matter.

Turning to FIG. 2, an example of a cross-sectional view of loudspeaker enclosure 100 along line A-A in the front view of FIG. 1 in accordance with some embodiments of the disclosed subject matter is shown. As illustrated, in some embodiments, loudspeaker enclosure 100 can include a rear side 202.

In some embodiments, rear side 202 can be any suitable shape and/or size. For example, in some embodiments, rear side 202 can be a substantially flat rectangle. As a more particular example, in some embodiments, rear side 202 can be a substantially flat rectangle having a width of 23½ inches, a height of 19 inches, and/or a thickness of ¾ inches.

In some embodiment, lower front side 106A and upper front side 106B can be offset from each other in any suitable manner. For example, in some embodiments, lower front side 106A can protrude forward from rear side 202 than upper front side 106B. As a more particular example, lower front side 106A can be arranged 15½ inches from rear side 202 and/or upper front side 106B can be arranged 14 inches from rear side 202 such that lower front side 106A and upper front side 106B are offset with respect to each other by 1½ inches. In some embodiments, lower front side 106A and/or upper front side 106B can each be arranged any suitable distance from rear side 202 such that lower front side 106A and upper front side 106B are offset with respect to each other by any suitable amount. In some embodiments, lower front side 106A and upper front side 106B can be parallel to each other.

In some embodiments, loudspeaker enclosure 100 can include a divider 204. In some embodiments, divider 204 can extend from an interior of lower front side 106A to rear side 202. For example, in some embodiments, divider 204 can extend from an interior of lower front side 106A to rear side 202 to bisect an interior portion of loudspeaker enclosure 100, as is shown in more detail in connection with FIGS. 3 and 4. In some embodiments, divider 204 can have any suitable shape and/or size. For example, in some embodiments, divider 204 can be a substantially flat rectangle. As a more particular example, in some embodiments, divider 204 can be a substantially flat rectangle having a width of 14 inches, a height of 9¾ inches, and a thickness of ¾ inches.

In some embodiments, divider 204 can include a hole 206. In some embodiments, hole 206 can be any suitable shape and/or size. For example, in some embodiments, hole 206 can be a substantially circular hole. As another example, in some embodiments, hole 206 can be a substantially circular hole that is 6 inches in diameter. In some embodiments, hole 206 can be arranged in divider 204 in any suitable manner. For example, in some embodiments, hole 206 can be arranged in a center of divider 204.

In some embodiments, loudspeaker enclosure 100 can include a table body 208. In some embodiments, table body 208 can be any suitable shape and/or size. For example, in some embodiments, table body 208 can be a substantially flat rectangle. As a more particular example, in some embodiments, table body 208 can be a substantially flat rectangle having a width of 5¼ inches, a length of 23½ inches, and/or a thickness of ¾ inches.

In some embodiments, table body 208 can have any suitable arrangement. For example, in some embodiments, table body 208 can connect lower front side 106A and upper front side 106B. As another example, in some embodiments, table body 208 can partially extend from lower front side 106A into an interior of loudspeaker enclosure 100 to define at least a portion of port 116 and/or at least a portion of port 118. As yet another example, in some embodiments, support body 120 and/or support body 122 can each be coupled to table body 208 and can each extend from table body 208 to an interior of top side 102. In some embodiments, table body 208 can provide structural support for a horn loudspeaker mounted to opening 114. In some embodiments, table body 208 can be supported by divider 204.

Figure 3:
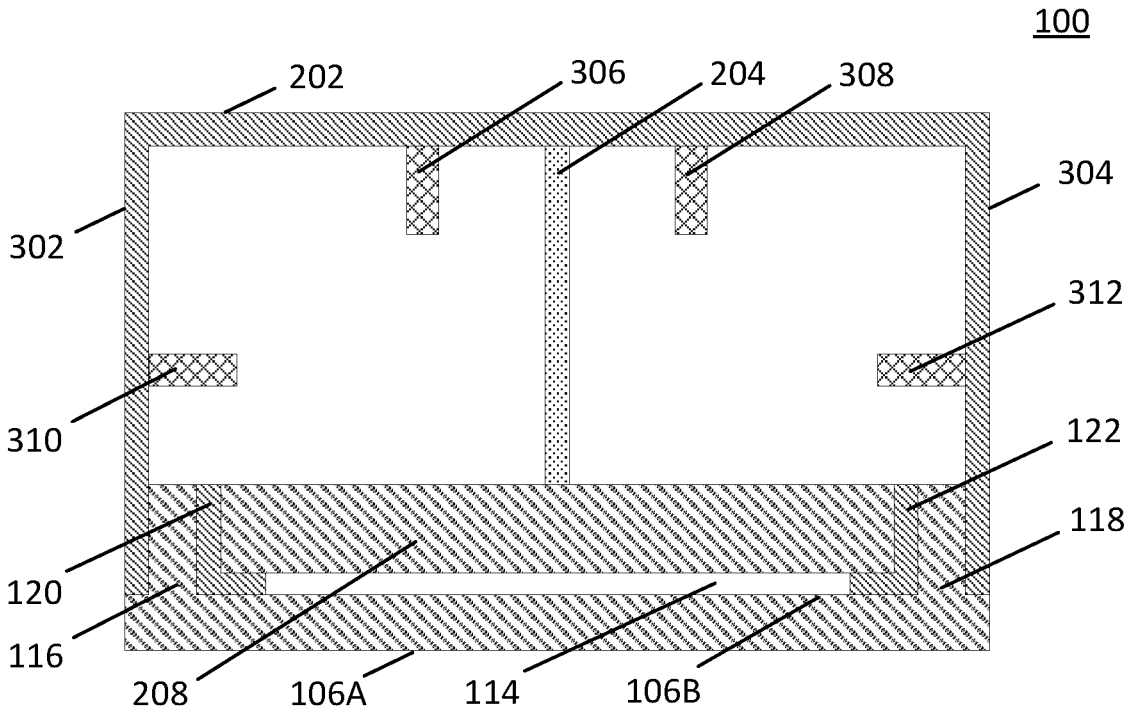
FIG. 3 shows an example of a cross-sectional view of a loudspeaker enclosure along line B-B in the front view of FIG. 1 in accordance with some embodiments of the disclosed subject matter.

Turning to FIG. 3, an example of a cross-sectional view of loudspeaker enclosure 100 along line B-B in the front view of FIG. 1 in accordance with some embodiments of the disclosed subject matter is shown. As illustrated, loudspeaker enclosure 100 can include a left side 302 and a right side 304.

In some embodiments, left side 302 and right side 304 can each have any suitable thickness. For example, in some embodiments, left side 302 and right side 304 can each have a thickness of ¾ inches. In some embodiments, an interior of left side 302 can define at least a portion of port 116. Similarly, in some embodiments, an interior of right side 304 can define at least a portion of port 118.

In some embodiments, loudspeaker enclosure 100 can include bracings 306, 308, 310, and/or 312 for structural support. In some embodiments, bracings 306, 308, 310, and/or 312 can be any suitable shape and/or size. For example, in some embodiments, bracings 306, 308, 310, and/or 312 can each have a width of 3 inches, a height of 22 inches, and/or a thickness of 1 inch.

In some embodiments, bracings 306, 308, 310, and/or 312 can be arranged in loudspeaker enclosure 100 in any suitable manner. For example, in some embodiments, bracing 306 and/or bracing 308 can each be coupled to an interior of rear side 202. As a more particular example, in some embodiments, bracing 306 and bracing 308 can each be coupled to an interior of rear side 202 such that bracing 306 is spaced 8 inches from bracing 308. Additionally or alternatively, in some embodiments, bracing 310 can be coupled to an interior of left side 302. For example, in some embodiments, bracing 310 can be coupled to left side 302 such that bracing 310 is arranged 6¼ inches from rear side 202. Additionally or alternatively, in some embodiments, bracing 312 can be coupled to an interior of right side 304. For example, in some embodiments, bracing 312 can be coupled to right side 304 such that bracing 312 is arranged 6¼ inches from rear side 202.

Figure 4:
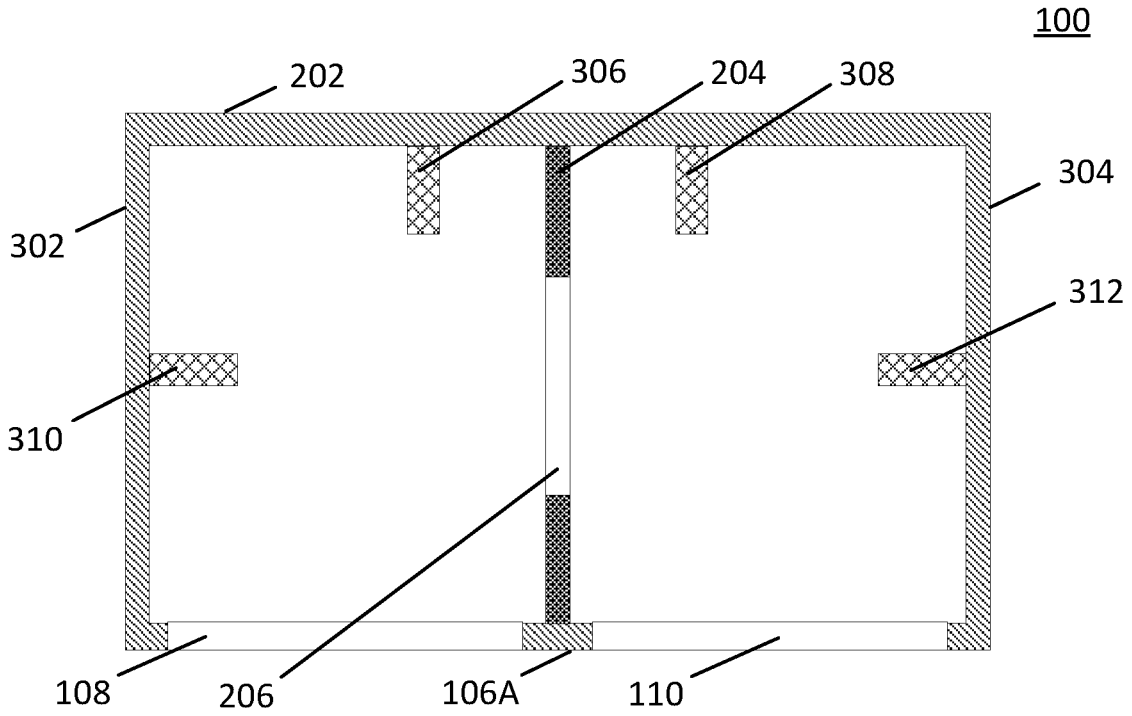
FIG. 4 shows an example of a cross-sectional view of a loudspeaker enclosure along line C-C in the front view of FIG. 1 in accordance with some embodiments of the disclosed subject matter.

Turning to FIG. 4, an example of a cross-sectional view of loudspeaker enclosure 100 along line C-C in the front view of FIG. 1 in accordance with some embodiments of the disclosed subject matter is shown.

Figure 5:
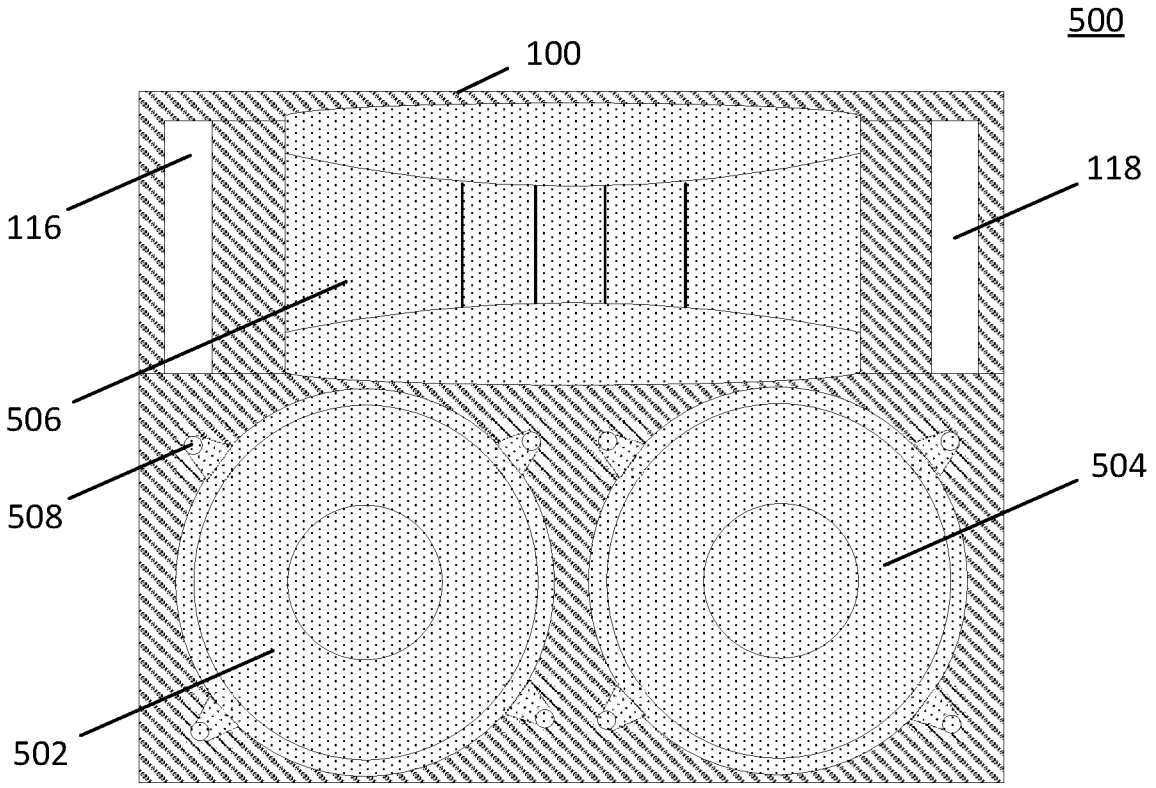
FIG. 5 shows an example of a front view of a loudspeaker device in accordance with some embodiments of the disclosed subject matter.

Turning to FIG. 5, an example of a front view of a loudspeaker device 500 in accordance with some embodiments of the disclosed subject matter is shown. As illustrated, in some embodiments, loudspeaker device 500 can include loudspeaker enclosure 100, port 116, port 118, loudspeaker 502, loudspeaker 504, and/or loudspeaker 506.

In some embodiments, loudspeaker 502 and/or loudspeaker 504 can be any suitable type of loudspeaker. For example, in some embodiments, loudspeaker 502 and/or loudspeaker 504 can each include one or more woofer loudspeakers. In some embodiments, loudspeaker 502 and/or loudspeaker 504 can each include any suitable driver element(s) to produce audio, such as a diaphragm, a voice coil, a magnet, and/or any other suitable element(s) (not shown). In some embodiments, loudspeaker 502 and/or loudspeaker 504 can each include any other suitable element(s).

In some embodiments, loudspeaker 502 and/or loudspeaker 504 can be coupled to loudspeaker device 500 in any suitable manner. For example, in some embodiments, loudspeaker 502 and/or loudspeaker 504 can be front-mounted to each of opening 108 and/or opening 110, respectively. Additionally, in some embodiments, loudspeaker 502 and/or loudspeaker 504 can be coupled to lower front side 106A of loudspeaker enclosure 100 using one or more screws 508. For example, in some embodiments, fasteners 112 can receive screws 508 to couple loudspeaker 502 and/or loudspeaker 504 to each of opening 108 and/or opening 110, respectively. In some embodiments, screws 508 can include one or more machine screws.

In some embodiments, loudspeaker 506 can be any suitable type of loudspeaker. For example, in some embodiments, loudspeaker 506 can include a horn loudspeaker. In some embodiments, loudspeaker 506 can include any suitable driver element(s) to produce audio, such as one or more diaphragms, one or more voice coils, one or more magnets, and/or any suitable element(s) (not shown). In some embodiments, loudspeaker 506 can include any other suitable element(s), such as one or more acoustic horns.

In some embodiments, loudspeaker 506 can be coupled to loudspeaker device 500 in any suitable manner. For example, in some embodiments, loudspeaker 506 can be front-mounted to opening 114. In some embodiments, loudspeaker 506, when mounted in opening 116, can protrude from upper front side 106B.

In some embodiments, loudspeaker enclosure 100 can include an insulation lining (not shown). For example, in some embodiments, insulation lining can include a fiberglass batting and/or any suitable insulative material. In some embodiments, insulation lining can be arranged in any suitable manner. For example, in some embodiments, insulation lining can be fixed to an interior of top side 102, an interior of bottom side 104, an interior of rear side 202, and interior of left side 302, and/or an interior of right side 304.

In some embodiments, elements of loudspeaker enclosure 100, such as top side 102, bottom side 104, front side 106, rear side 202, left side 302, right side 304, support body 120, support body 122, divider 204, table body 208, bracing 306, bracing 308, bracing 310, and/or bracing 312, can be constructed of any suitable material in any suitable manner. For example, in some embodiments, elements of loudspeaker enclosure 100 can be constructed of a medium-density fiberboard, a Baltic birch plywood, and/or any suitable material. In some embodiments, elements of loudspeaker enclosure 100 can be joined in any suitable manner. For example, in some embodiments, elements of loudspeaker enclosure 100 can be joined using glue and/or any suitable material, and/or using dowel joints, dovetail joints, box joints, interlocking joints, mortise and tenon joints, half lap joints, dado joints, and/or any other suitable type of joints. In some embodiments, joints of loudspeaker enclosure 100 can be air-tight.

In some embodiments, loudspeaker device 500 can include any suitable circuitry. For example, loudspeaker device 500 can include one or more input circuits for receiving audio signals from one or more external sources, one or more signal processing circuits (e.g., amplifier(s), convertor(s), crossover(s), equalizer(s), compressor(s), limiter(s), and/or any suitable signal processing circuits), one or more control circuits, one or more power circuits, and/or one or more transmission circuits for transmitting received and/or processed audio signals to loudspeaker 502, loudspeaker 504, and/or loudspeaker 506 (not shown).

In some embodiments, loudspeaker device 500 can include any other suitable components.

Accordingly, loudspeaker enclosures and loudspeaker devices are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. A loudspeaker enclosure, comprising:

a rear side; and a front side of the loudspeaker enclosure comprising:

a lower portion of the front side comprising a first opening for receiving a first loudspeaker and a second opening for receiving a second loudspeaker; and an upper portion of the front side comprising a third opening for receiving a third loudspeaker, a first port, and a second port, wherein a distance from the lower portion of the front side to the rear side is greater than a distance from the upper portion of the front side to the rear side, wherein the diameter of the first opening is 9 inches, wherein the width of the first port is 1¼ inches, and wherein the height of the first port is 7 inches.

2. The loudspeaker enclosure of claim 1, wherein the upper portion of the front side further comprises:

a first support body that defines at least a portion of the first port and at least a portion of the third opening; and a second support body that defines at least a portion of the second port and at least a portion of the third opening.

3. The loudspeaker enclosure of claim 1, wherein:
a first line extending from a center of the first port to a center of the second port passes through at least a portion of the third opening; and
a second line extending from a center of the first opening to a center of the second opening is parallel to the first line.

4. The loudspeaker enclosure of claim 1, wherein:
the first opening has a circular shape for receiving a woofer loudspeaker;
the second opening has a circular shape for receiving a woofer loudspeaker; and
the third opening has a rectangular shape for receiving a horn loudspeaker.

5. The loudspeaker enclosure of claim 1, wherein:
the first port has a rectangular shape; and
the second port has a rectangular shape.

6. The loudspeaker enclosure of claim 1, further comprising a divider partially bisecting an interior portion of the loudspeaker enclosure.

7. The loudspeaker enclosure of claim 6, wherein the divider comprises a hole formed in a center thereof.

8. The loudspeaker enclosure of claim 1, wherein:
the first port and the second port are arranged on the upper portion of the front side adjacent to respective lateral sides of the third opening; and
the third opening has a rectangular shape for receiving a horn loudspeaker that protrudes from the upper portion of the front side.

9. The loudspeaker enclosure of claim 1, wherein:
the distance between the center of the first opening and the center of the second opening is 11 inches.

10. A loudspeaker device comprising:
a loudspeaker enclosure, comprising:
a rear side; and
a front side of the loudspeaker enclosure comprising:
a lower portion of the front side comprising a first opening for receiving a first loudspeaker and a second opening for receiving a second loudspeaker; and
an upper portion of the front side comprising a third opening for receiving a third loudspeaker, a first port, and a second port,
wherein a distance from the lower portion of the front side to the rear side is greater than a distance from the upper portion of the front side to the rear side;
the first loudspeaker positioned in the first opening;
the second loudspeaker positioned in the second opening; and
the third loudspeaker positioned in the third opening,
wherein the diameter of the first opening is 9 inches,
wherein the width of the first port is 1¼ inches, and
wherein the height of the first port is 7 inches.

11. The loudspeaker device of claim 10, wherein the upper portion of the front side further comprises:
a first support body that defines at least a portion of the first port and at least a portion of the third opening; and
a second support body that defines at least a portion of the second port and at least a portion of the third opening.

12. The loudspeaker device of claim 10, wherein:
a first line extending from a center of the first port to a center of the second port passes through at least a portion of the third opening; and
a second line extending from a center of the first opening to a center of the second opening is parallel to the first line.

13. The loudspeaker device of claim 10, wherein:
the first loudspeaker is a woofer loudspeaker;
the second loudspeaker is a woofer loudspeaker; and
the third loudspeaker is a horn loudspeaker.

14. The loudspeaker device of claim 10, wherein:
the first port has a rectangular shape; and
the second port has a rectangular shape.

15. The loudspeaker device of claim 10, further comprising a divider partially bisecting an interior portion of the loudspeaker enclosure.

16. The loudspeaker device of claim 15, wherein the divider comprises a hole formed in a center thereof.

17. The loudspeaker device of claim 10, wherein:
the third loudspeaker is a horn loudspeaker that protrudes from the upper portion of the front side; and
the first port and the second port are arranged on the upper portion of the front side adjacent to respective lateral sides of the third loudspeaker.

18. The loudspeaker device of claim 10, wherein:
the distance between the center of the first opening and the center of the second opening is 11 inches.

19. A loudspeaker device comprising:
a loudspeaker enclosure, comprising:
a rear side; and
a front side of the loudspeaker enclosure comprising:
a lower portion of the front side comprising a first opening and a second opening, wherein the first opening and the second opening are horizontally aligned; and
an upper portion of the front side comprising a third opening, a first port, and a second port, wherein the first port and the second port are arranged on the upper portion of the front side adjacent to respective lateral sides of the third opening;
wherein a distance from the lower portion of the front side to the rear side is greater than a distance from the upper portion of the front side to the rear side;
a first woofer loudspeaker positioned in the first opening;
a second woofer loudspeaker positioned in the second opening; and
a horn loudspeaker positioned in the third opening,
wherein the diameter of the first opening is 9 inches,
wherein the width of the first port is 1¼ inches, and
wherein the height of the first port is 7 inches.

20. The loudspeaker device of claim 19, wherein:
the distance between the center of the first opening and the center of the second opening is 11 inches.

* * * * *